United States Patent [19]

Strugala et al.

[11] 4,339,937

[45] Jul. 20, 1982

[54] RING ROLLING MILL

[75] Inventors: Alfred Strugala; Erich Dittrich, both of Dortmund; Helmut Siewert, Castrop-Rauxel, all of Fed. Rep. of Germany

[73] Assignee: Thyssen Industrie AG, Fed. Rep. of Germany

[21] Appl. No.: 156,927

[22] Filed: Jun. 6, 1980

[30] Foreign Application Priority Data

Jun. 7, 1979 [DE] Fed. Rep. of Germany ..... 2923001

[51] Int. Cl.[3] ..... B21H 1/06

[52] U.S. Cl. ..... 72/110; 72/105

[58] Field of Search ..... 72/94, 105, 106, 107, 72/110, 111

[56] References Cited

U.S. PATENT DOCUMENTS

| | | | |
|---|---|---|---|
| 2,567,334 | 9/1951 | Harrison et al. | 72/105 |
| 3,815,402 | 6/1974 | Duran et al. | 72/94 |
| 4,047,414 | 9/1977 | Druge et al. | 72/110 |

FOREIGN PATENT DOCUMENTS

| | | | |
|---|---|---|---|
| 2615802 | 10/1977 | Fed. Rep. of Germany | 72/110 |

*Primary Examiner*—Lowell A. Larson

*Attorney, Agent, or Firm*—McGlew and Tuttle

[57] ABSTRACT

A ring rolling mill is disclosed which has a rolling mill frame, a rolling platform mounted to the frame, a main roll movably mounted on the frame, a plurality of elongated mandrel rolls mounted laterally of the main roll, and a plurality of mandrel roll bearing housings each supporting oppositely disposed ends of each mandrel roll. Each mandrel roll and one bearing associated therewith is axially displaceable.

10 Claims, 3 Drawing Figures

RING ROLLING MILL

FIELD AND BACKGROUND OF THE INVENTION

The invention relates, in general, to metal forming and, more particularly, to an improved ring rolling mill for rolling rings.

West German Pat. No. 703,436 discloses a ring rolling mill having a main roll and several mandrel rolls mounted on a turntable, and supported by bearings at both ends, which cooperate successively with the main roll. One of the bearings is removable to be able to introduce and remove the workpiece. The mandrel with one bearing or the one bearings with their bearing journal are displaceable in axial direction successively by a drive with automatic control derived from the movement of the turntable. In this known design, the various mandrel roll parts are each mounted in a carriage. The carriage is axially displaceable on the turntable and contains a pressure cylinder. A piston rigidly connected with the turntable is arranged in each cylinder.

This known ring rolling mill is expensive and heavy. Since the turntable absorbs the full rolling force, it lacks rigidity and the accuracy in the dimension and form of the rolled rings cannot meet today's requirements.

Adjustment of the rolls is effected by the rotation of the turntable by a fixed amount, so that unavoidable volume tolerance of the ring blanks used manifest themselves as diameter tolerances of the rolled ring, which leads to further inaccuracies.

Finally, the continuous rotation of the heavy turntable, in contrast to a stepwise movement of the turret head, on the one hand, results in a relatively long station time, while on the other hand, the introduction of the ring blanks becomes more difficult, particularly when automatic devices are to be used for this purpose.

West German Pat. No. 469,226 describes a ring rolling mill, characterized as a tire mill, where the main roll is arranged on an adjustable carriage. German published patent application DOS No. 2,615,802 discloses a ring rolling mill of a different class.

SUMMARY OF THE INVENTION

The invention is directed to the objective of improving the economy of ring rolling by increasing form and dimension accuracy, by shortening station times, and simple automation of the workpiece feed.

In accordance with the invention, a ring rolling mill is provided with a rolling mill frame, a rolling platform mounted to the frame, a main roll movably mounted on the frame, a plurality of elongated mandrel rollers, a plurality of mandrel roll bearing housings, each supporting an oppositely disposed end of each mandrel roll, each mandrel roll and one bearing associated therewith being axially displaceable, a turret rotatably mounted on the frame at a spaced location above the main roll, carriage means on said frame for radially moving the main roll, a supporting arm rigidly connected to the frame and projecting into the space between said turret and said main roll, and said axial displaceable mandrel roll bearing housing being displaceable to bear upon said supporting arm for rolling a ring.

The fact that only one bearing housing of each mandrel roll is arranged on the turret head, permits the use of moving masses with minimum dimensions. In contrast to the design according to German published patent application DOS No. 2,615,802, the inventive device has shortened station times, since the entire turret head must be raised and lowered there.

The arrangement of the main roll on an adjustable carrier has the advantage of accurate, adjusting movements which are easy to control or regulate, or both, even automatically, and mandrel rolls which stand are stationary during the rolling. This extremely facilitates the automatic performance of activities on the mandrel rolls which are not involved at that time in the rolling process, for example, cooling, lubricating, unloading, loading.

Due to the fact that each displaceable mandrel roll bearing housing can be supported in rolling position on a supporting arm that is rigidly connected to the rolling mill frame and protrudes into the space between the main roll and the turret head, the rigidity or stiffness of the machine is greatly increased, and thus the working precision by shorter frictional connection. Besides, the forces acting on the turret head are reduced to such an extent that the turret head can be made very light and has a corresponding low inertia moment. This permits short switching times and thus correspondingly short station times. Even the guide surfaces of the mandrel roll bearing housings and of the supporting arm can be so designed that the bearing housing no longer bears in rolling position on the turret head, but only on the supporting arm. The turret head then no longer absorbs any rolling forces and has only the function of a tool magazine.

A preferred embodiment of the inventive arrangement produces measures for eliminating loose connections and thus for further increasing the stiffness and rigidity of the machine.

In accordance with still another embodiment of the invention, there is only one support for all mandrel rolls on the stationary rolling mill frame and the support of the second mandrel roll end during the rolling process can be made particularly still or rigid at little cost.

Other embodiments contribute to the additional increases in the economical operation of ring rolling mills, according to the invention by providing means with which damaged or worn out rolls with their bearing housings can be exchanged rapidly against relacement units prepared outside the machine.

In accordance with even still another embodiment, further ring quality improvements are possible by providing additionally an axial roll stand.

Accordingly, it is an object of the invention to provide a ring rolling mill which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
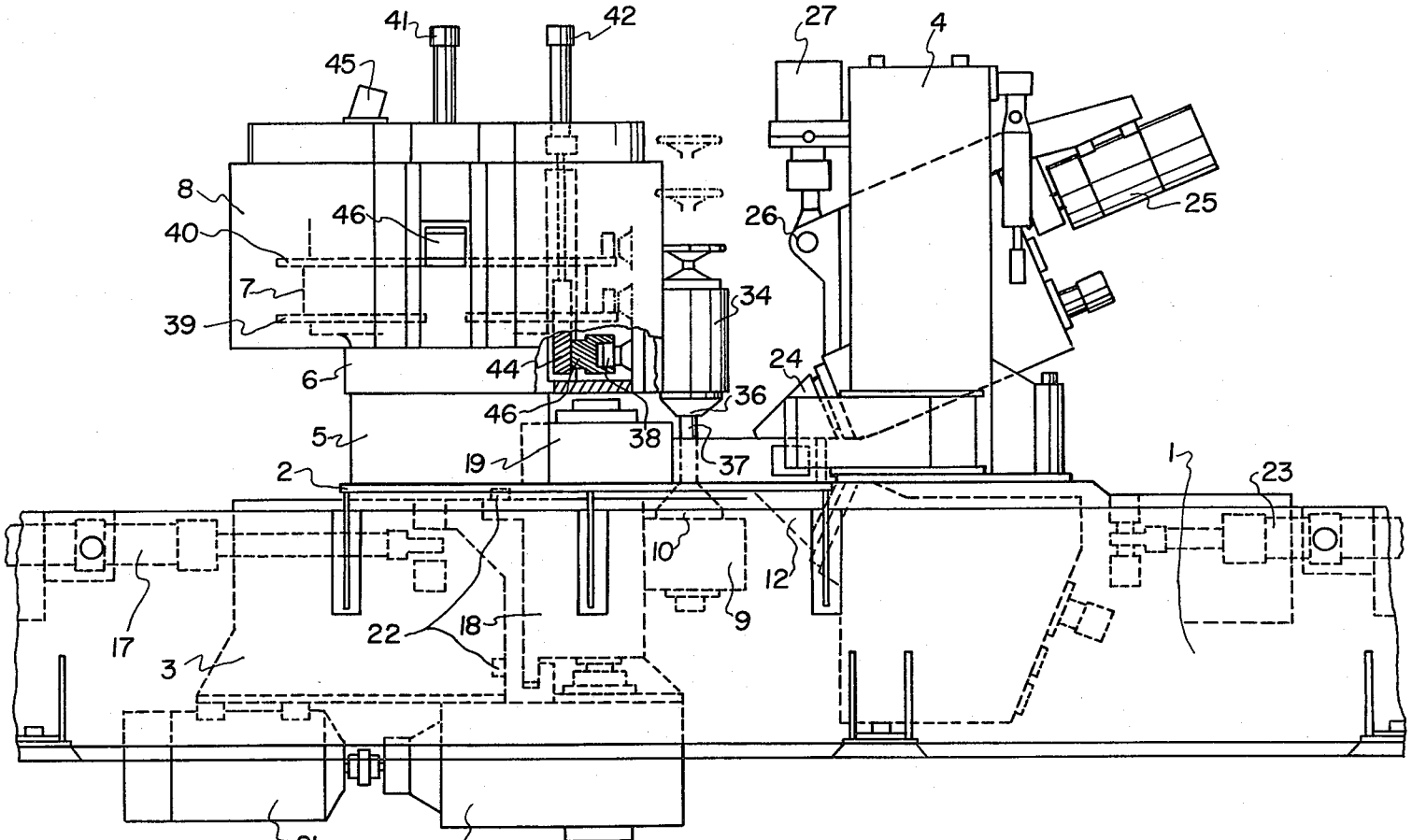
FIG. 1 shows a partial side elevation of a ring rolling mill.

Referring now to the drawings, wherein like reference characters refer to like or corresponding parts throughout the several views, there is shown an elongated machine frame 1 having a rolling platform 2 mounted on the frame for the automatic feeding and removal of workpieces such as ring blanks and rings formed therefrom. The machine includes guides (not shown) in which a radial carriage 3 and an axial stand 4, which are linearly displaceable in the longitudinal direction of the machine, are guided. A bridge-type superstructure 5 is mounted on machine frame 1. The superstructure 5 carries a mandrel roll supporting arm 6 and above it, a tubular axle beam 7 on which a ring shaped turret head 8 is mounted for rotation.

The machine frame 1 has a crossarm 9 in which there is arranged a bottom mandrel roll bearing housing 10 disposed substantially parallel to the longitudinal axis of the machine.

The rolling platform 2 is formed in the shape of a horseshoe. In the vicinity of a rolling station 11, located above the mandrel roll bearing housing 10, the rolling platform 2 has a recess for the passage of the end of the mandrel roll. It is also recessed for the dipping of a bottom conical axial roll 12.

A loading station 13 having an automatic loading device 14, represented only by an arrow, is arranged, at ninety degrees relative from the rolling station 11, for charging the rolling platform 2 with ring blanks. An unloading station 15, with an automatic unloading device 16, is provided to push the finished, rolled ring off of the rolling platform 2.

Radial carriage 3 can be displaced by means of a piston-cylinder unit 17, admitted with a pressure medium, namely in known manner with automatic control or regulation, or both, of the displacement path. On the radial carriage 3, there are secured a bearing housing 18 for the rotatably supporting a main roll 19, a gear 20, and a motor 21 for driving main roll 19. The bearing housing 18 is secured with easily detachable coupling elements on radial carriage 3, while the gear 20 is connected by a plug coupling (not shown), so that main roll 19, together with its bearing housing 18, can be easily and rapidly disengaged from radial carriage 3, as well as assembled and dissembled in the corresponding position of radial carriage 3, through central openings in parts 5 to 8.

Figure 2:
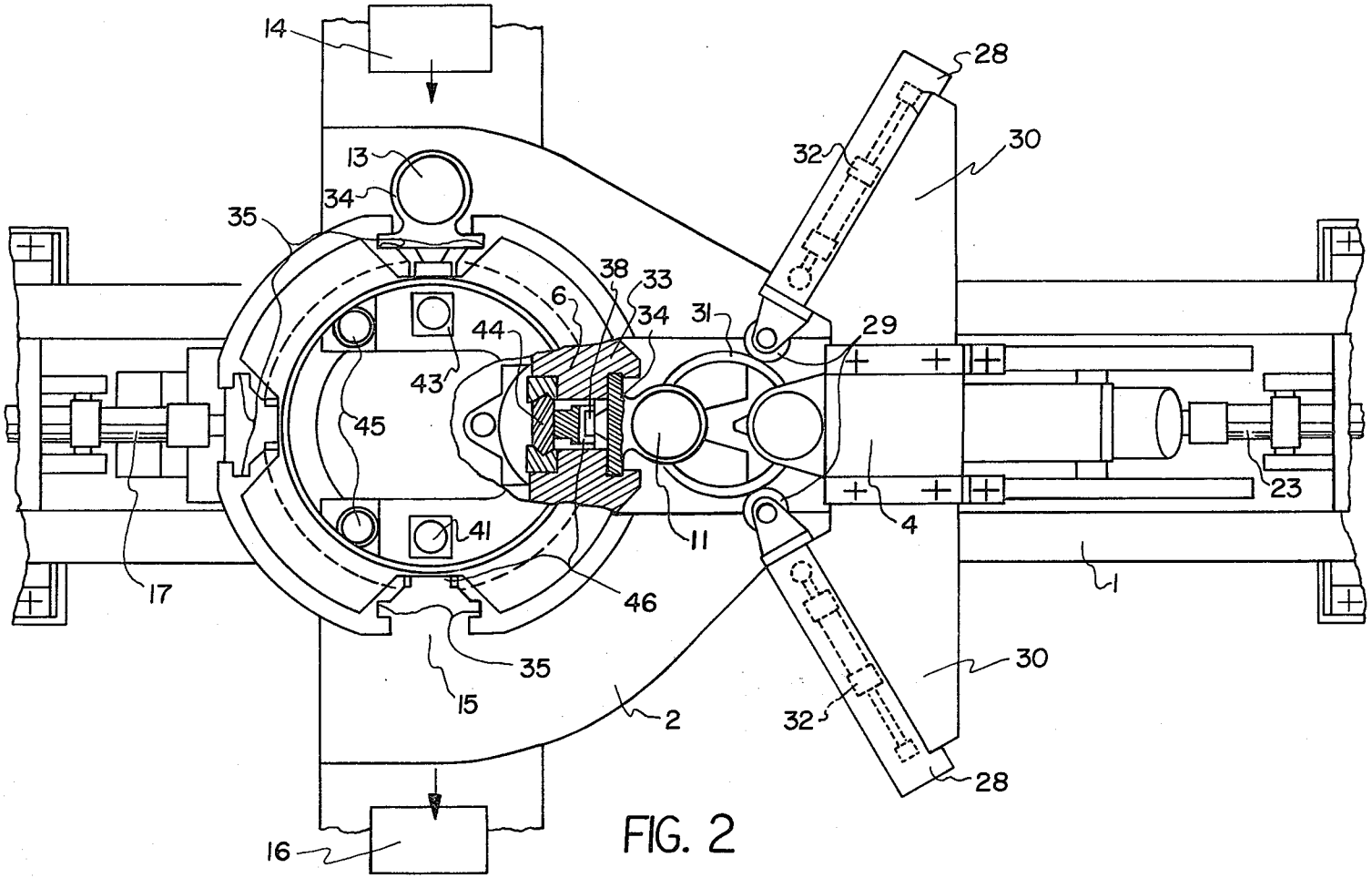
FIG. 2 shows a partial top view, partly in section, of FIG. 1.
Figure 3:
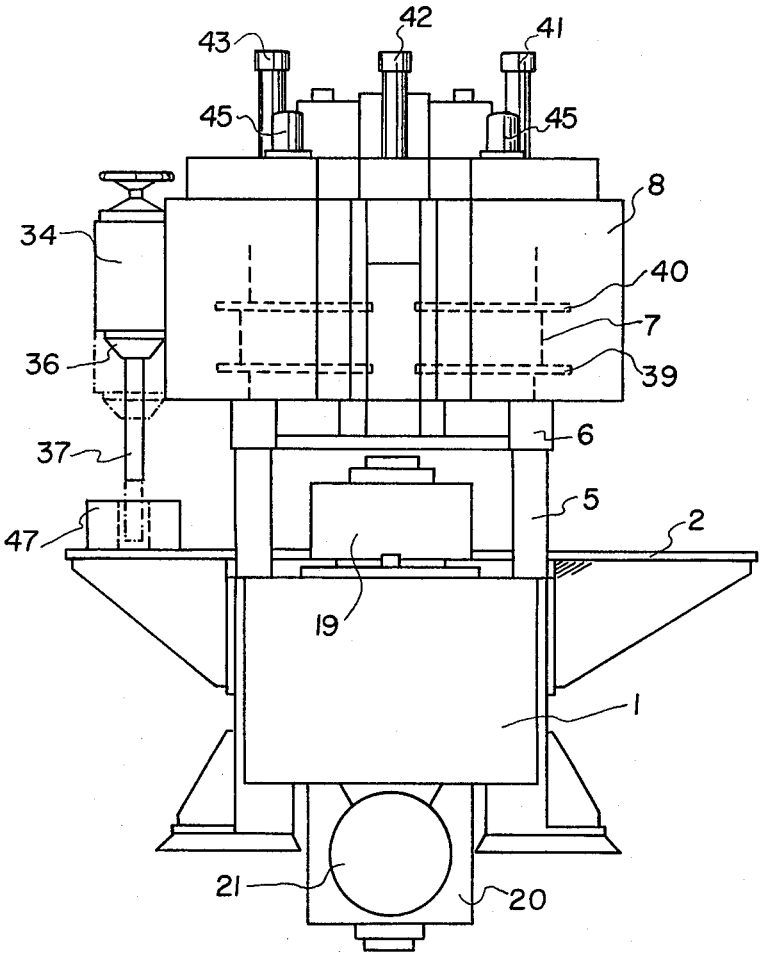
FIG. 3 shows a front view of FIG. 1.

As is best shown in FIG. 2, axial stand 4 may be displaced by a piston-cylinder unit 23 containing a suitable pressure medium. The bottom conical axial roll 12 is rotatable in axial stand 4, but not displaceable. A top conical axial roll 24 is driven by a motor 25 and mounted in carriage 26, which is vertically displaceable in axial stand 4 by a drive 27 and which can be admitted with an axial roll force. This drive can likewise be a piston-cylinder unit that can be admitted alternately on both sides with a pressure medium.

In addition, centering roller carriers 28, having centering rollers 29, are displaceable on axial stand 4 in guides 30 substantially radially to a ring 31 which is disposed in the rolling position. Displacements of centering rollers 29, and their admission with a centering force, are effected by piston-cylinder units 32 which can be admitted alternately on both sides with a pressure medium, and which can be actuated with known controls or regulating means.

Supporting arm 6 is designed for maximum rigidity or stiffness against the radial rolling forces and has, in the vicinity of the rolling station, correspondingly rigid guide-ways 33 for guiding and supporting top mandrel roll bearing housings 34, as well as clamping or locking elements (not shown). A top view of supporting arm 6 shows it in the vicinity of guideway 33.

Turret head 8, which rotates on tubular axle beam 7, can be turned by a conventional drive 45 (not shown specifically) of ninety degree steps. It has on its outer circumference, at spaced ninety degree intervals, vertical guideways 35 for guidance of the top mandrel roll bearing housings 34. Since turret head 8 does not have to absorb radial rolling forces or only minor ones, and is stressed substantially only by the frictional forces appearing by the movement of the ring through the ring rolling mill, as well as by corresponding moments, turret head 8, as well as guideways 35 can be made very light and thus low in inertia.

In guideways 33 and 35, of which only two are shown, mandrel roll bearing housings 34 are arranged which are displaceable and readily replaceable.

Furthermore, as can be seen from the drawings, mandrel rolls 37 are inserted in rotatable bearing sleeves 36 of mandrel roll bearing housings 34, which can be locked or released by automatic means (not shown). In its lower position, the mandrel roll bearing housing 34 bears substantially on mandrel roll supporting arm 6 and is clamped there. Mandrel rolls 37 in the various bearing housing can be designed identically or differently, for example, as a roughing roll mandrel or as a finishing roll mandrel.

Shifting drives, not shown specifically, permit setting and holding the mandrel roll bearing housings 34 at three levels. In the lowermost position, the mandrel roll bearing housing 34 bears substantially on mandrel roll supporting arm 6 and is clamped there. The roll end of the bottom mandrel roll 37 in rolling station 11 is in operative connection with the bottom mandrel roller-bearing sleeve 36.

In the center position, the mandrel roll bearing housing 34 is disengaged from mandrel roll supporting arm 6. The lower end of the mandrel roll 37 is just above rolling platform 2, so that the mandrel roll protruding into the ring transports, during the rotation of rolling platform 2, a ring blank to be rolled from loading station 13 to rolling station 11 or a finish rolled ring from rolling station 11 to unloading station 15.

In the top position, the mandrel roll releases the ring completely, so that a ring blank is pushed onto rolling platform 2 or under the mandrel roll, 37 or the finish rolled ring can be pushed down from rolling platform 2.

The shifting drives for mandrel roll bearing housings 34 can be designed in any known manner. In the interest of a small turret head mass and a simple energy supply, however, it is advisable to allow stationary drives on tubular axle beam 7. For example, mandrel roll bearing housings 34 have to this end each a guide roller 38. Axle beam 7 is provided, on its outside surface, with guide rings 39 and 40, which are interrupted in the areas of loading station 13, rolling station 11 and unloading station 15 by an amount that is slightly greater than the diameter of guide roller 38. Bottom guide ring 39 corresponds to the central, the upper guide ring 40 to the top position of mandrel roll bearing housing 34. In the vicinity of loading station 13, rolling station 11 and unloading station 15 a shifting device 41, 42, 43 is arranged which consists of a piston-cylinder unit secured onto tubular axle beam 7 and admitted alternately on both sides with a pressure medium, and of a slide 44 secured on the respective piston rod and guided in axle beam 7. Slide 44 has a cantilever 46. The end of the cantilever is U-shaped so that it can grip guide rollers 38 of mandrel roll bearing housings 34 at the top and bottom. The sides of the U-shaped end are slightly narrower than the interruptions of guide rings 39 and 40.

The operation of the illustrated ring rolling mill may now be described. In loading position, slide 44 of shifting device 43 has moved up so far that cantilever 46 keeps guide roller 38 at the level at which it can roll on guide ring 40. A ring blank is pushed under the mandrel roll. The piston of shifting device 43 is now adjusted so that its cantilever 46 shifts guide rollers 38 to the level of the lower guide ring 39.

Turret head 8 is now turned by ninety degrees, and the mandrel roll pushes ring blank 47 on rolling platform 2 into rolling station 11 and guide roller 38 rolls over guide ring 40, into the U-shaped end of the cantilever of slide 44 of shifting device 42.

Then slide 44, and with it the mandrel roll-bearing housing 34 is moved down until the bottom end of the mandrel roll 37 is in mandrel roll bearing housing 10.

The rolling process takes place as usual.

Then slide 44 lifts guide roller 38 again to the level of bottom guide ring 39, and turret head 8 is turned again by ninety degrees, while the mandrel roll feeds the finish rolled ring to unloading station 15.

At the unloading station, shifting device 41 lifts guide roller 38 to the level of bottom guide ring 40, so that the finished ring can be pushed off rolling platform 2.

During the rotation of turret head 8, guide roller 38 rolls onto top guide ring 40 and is thus in a mandrel roll cooling and lubricating station; and rolls during the next indexing step again into loading station 13. It is also possible to use stations 13 and 15 alternately as loading and unloading station, and to index turret head 8 alternately by one hundred eighty degrees in both directions of rotation.

It is also possible to provide mandrel roll bearing housings 34 with different mandrel rolls, for example, for the inner calibration of the rings and to make the respective mandrel roll available automatically for the rolling process.

Finally, it is possible to equip turret head 8 and rolling platform 2 so that more or less than four mandrel roll bearing housings can be provided.

For removing a mandrel roll bearing housing 34 from turret head 8, the mandrel roll bearing housing is moved into the top position and turret head 8 is turned so far that guide roller 38 rolls out of the U-shaped cantilever of one of the shifting devices 41,42,43 onto top guide ring 40, that is, it is uncoupled from the shifting device.

While specific embodiments of the invention have been shown and described in detail to illustrate the application of the principles of the invention, it will be understood that the invention may be embodied otherwise without departing from such principles.

What is claimed is:

1. A ring rolling mill comprising a rolling mill frame, a rolling platform mounted to the frame, a main roll movably mounted on the frame, a plurality of elongated mandrel rolls mountable laterally of said main roll, a plurality of upper mandrel roll bearing housings, each housing supporting one of the oppositely disposed ends of a mandrel roll, each mandrel roll and one bearing housing associated therewith being axially displaceable, a turret rotatably mounted on the frame at a spaced location above the main roll, carriage means for radially moving the main roll, a supporting arm rigidly connected to the frame and projecting into the space between said turret and said main roll, and said axial displaceable mandrel roll bearing housing being displaceable to engage with and bear upon said supporting arm for rolling a ring.

2. The ring rolling mill as set forth in claim 1, wherein said supporting arm includes means for form locking with regard to the forces acting radially to the mandrel roll.

3. The ring rolling mill as set forth in claim 2, wherein said form locking means includes surfaces having a profile complementary to that of the mandrel roll bearing housing arranged on said turret head.

4. The ring rolling mill as set forth in claim 1 further comprising a bearing for receiving the end of the mandrel roll in rolling position connected with the rolling mill frame.

5. The ring rolling mill as set forth in claim 1 further comprising means for axially displacing said axial displaceable mandrel roll bearing housing detachably connected to the frame.

6. The ring rolling mill as set forth in claim 1 further comprising at least two rolls for machining ring end faces, one of which is axially stationary and rotatably mounted, and the other of which is rotatable and displaceable in the axial direction of the ring to be rolled, a motor for driving at least one of the rolls.

7. A ring rolling mill for rolling a ring in the gap between a movable main roll and a mandrel roll comprising:

a frame;

a rolling platform connected to said frame for supporting rings to be rolled at and between a loading, a rolling, and an unloading station;

a turret having at least one guideway, rotatably mounted to said frame for selectively positioning said guideway at said loading, rolling and unloading stations;

turret drive means connected to said frame for rotating said turret;

an upper mandrel roll bearing housing for rotatably receiving the mandrel, slidably mounted to said guideway for movement vertically of said platform;

housing drive means associated with said upper mandrel roll bearing housing for moving said housing with the mandrel to a first upper position at said loading station for positioning a ring to be rolled on said platform, to a second bottom position at said rolling station for forming the gap, and to a third intermediate position with said mandrel spaced from said platform for engaging a ring and moving it with movement of said turret between said stations; and a rigid support arm fixed to said frame having a guideway extension positioned at said rolling station for receiving said housing in said housing bottom position.

8. A ring rolling mill according to claim 7, including a bottom bearing housing fixed to said frame at said rolling station for receiving a lower end of the mandrel in said upper housing second bottom position.

9. A ring rolling mill according to claim 8, wherein said turret includes an upper guide which is interrupted at said stations and a lower guide which is interrupted at said stations, said upper housing comprising guide following means extending therefrom and selectively engageable with said upper guide in said upper housing first position and said lower guide in said upper housing third position.

10. A ring rolling mill according to claim 9, wherein said upper and lower guides comprise guide rings extending axially of said turret, said guide following means comprising a roller rotatably mounted to said upper housing.

* * * * *